US008323052B2

(12) United States Patent
Sun et al.

(10) Patent No.: US 8,323,052 B2
(45) Date of Patent: Dec. 4, 2012

(54) CONNECTOR ASSEMBLY

(75) Inventors: Zheng-Heng Sun, Tu-Cheng (TW); Li-Ren Fu, Shenzhen (CN); Jun-Hui Wang, Shenzhen (CN); Ai-Ling He, Shenzhen (CN); Han-Bing Zhang, Shenzhen (CN); Jun He, Shenzhen (CN); An-Gang Liang, Shenzhen (CN); Lei Liu, Shenzhen (CN); Shu-Ni Yi, Shenzhen (CN); Ping-Chuan Deng, Shenzhen (CN); Lin Du, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/115,120

(22) Filed: May 25, 2011

(65) Prior Publication Data

US 2012/0231659 A1 Sep. 13, 2012

(30) Foreign Application Priority Data

Mar. 8, 2011 (CN) ..... 2011 1 0054729

(51) Int. Cl.
*H01R 13/73* (2006.01)

(52) U.S. Cl. ..... 439/564; 439/577

(58) Field of Classification Search ..... 439/573, 439/572, 571, 569, 564, 565, 577
See application file for complete search history.

(56) References Cited

U.S. PATENT DOCUMENTS

| | | | | |
|---|---|---|---|---|
| 5,871,373 | A * | 2/1999 | Pacini et al. | 439/587 |
| 6,695,641 | B1 * | 2/2004 | Lee | 439/493 |
| 6,790,052 | B2 * | 9/2004 | Schmidgall et al. | 439/79 |
| 7,037,118 | B2 * | 5/2006 | Neumetzler et al. | 439/76.1 |
| 7,548,434 | B2 * | 6/2009 | Busse et al. | 361/827 |
| 7,618,261 | B2 * | 11/2009 | Busse et al. | 439/49 |
| 2003/0139093 | A1 * | 7/2003 | Zhang | 439/571 |
| 2003/0207600 | A1 * | 11/2003 | Ho | 439/79 |
| 2003/0224646 | A1 * | 12/2003 | Wu | 439/328 |
| 2006/0232944 | A1 * | 10/2006 | Zhang et al. | 361/719 |

* cited by examiner

*Primary Examiner* — Neil Abrams
*Assistant Examiner* — Phuongchi Nguyen
(74) *Attorney, Agent, or Firm* — Altis Law Group, Inc.

(57) ABSTRACT

A connector assembly includes a connector and two screws. The connector includes a main body, a cable connected to a rear side of the main body, and a connection portion protruding from a front side of the main body. Two threaded holes are defined in opposite ends of the main body, respectively. Two resilient fixing portions protrude from the rear side of the main body. A through hole is defined in each of the fixing portions. The screws are detachably received into the corresponding through holes of the fixing portions, and operable to mount the connector to an object by extending through the threaded holes to engage with the object.

3 Claims, 3 Drawing Sheets

CONNECTOR ASSEMBLY

CROSS-REFERENCE TO RELATED APPLICATIONS

Relevant subject matter is disclosed in a co-pending U.S. patent application, titled "DATA CABLE AND CONNECTOR THEREOF," and filed on Mar. 18, 2011, with the application Ser. No. 13/050,960, which is assigned to the same assignee as this patent application.

BACKGROUND

1. Technical Field

The present disclosure relates to a connector assembly.

2. Description of Related Art

Many connectors, such as serial advanced technology attachment (SATA) connectors, include a main body defining two threaded holes, and two screws fastened in the threaded holes. To assemble the connector to a connector interface of an electronic device, the screws are first disengaged from the threaded holes. When the connector is inserted into the connector interface, the screws extend through the corresponding threaded holes and engage in the electronic device. However, for manufacturers, fastening a number of screws in the threaded holes of the main bodies can be very time consuming and inconvenient for users.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
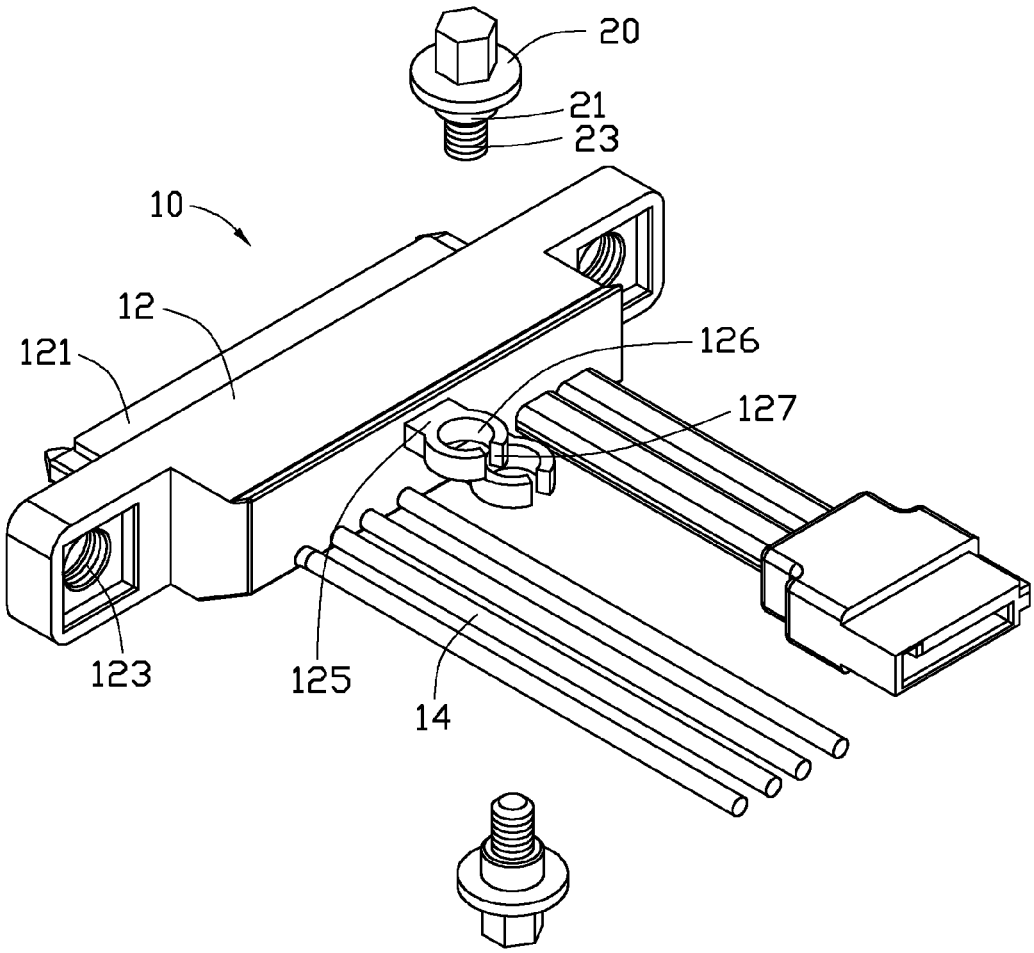
FIG. 1 is an exploded, isometric view of an embodiment of a connector assembly.
Figure 3:
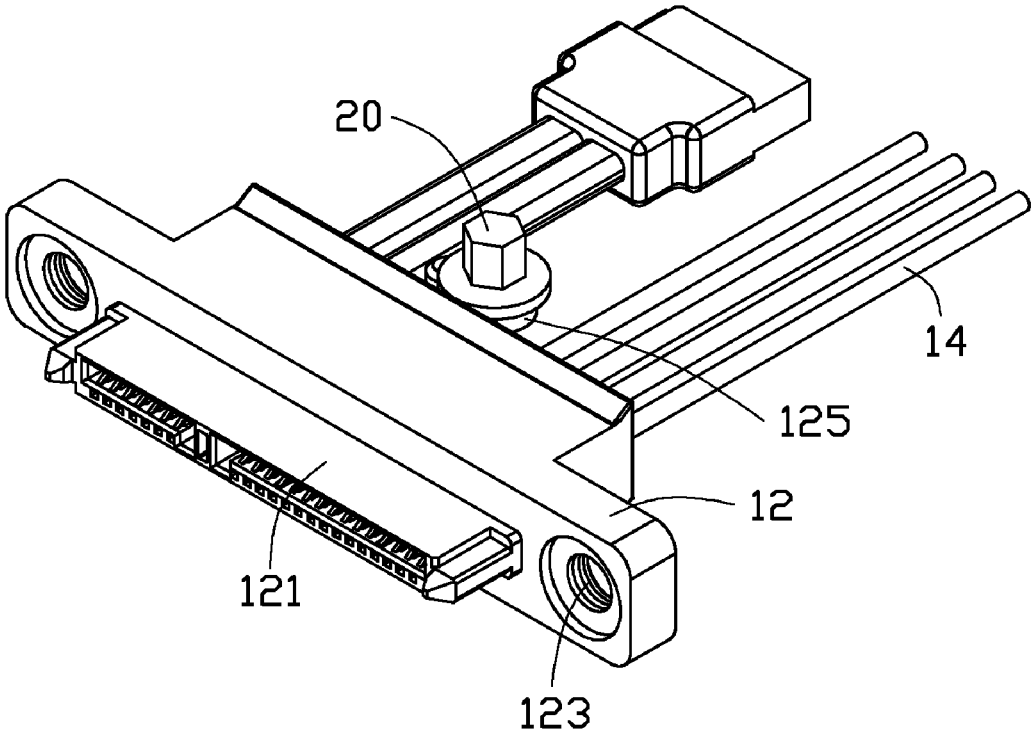
FIG. 3 is similar to FIG. 2, but viewed from another perspective.

Referring to FIGS. 1 and 3, an embodiment of a connector assembly includes a connector 10 and two screws 20.

The connector 10 includes a main body 12, and a plurality of cables 14 connected to a rear side of the main body 12. A connection portion 121 is formed on a front side of the main body 12, for being connected to a corresponding connector interface 31 of an electronic device 30. Two threaded holes 123 are defined in opposite ends of the main body 12, respectively. Two substantially C-shaped resilient fixing portions 125 protrude from the rear side of the main body 12. Each fixing portion 125 defines a through hole 126 in a middle of the fixing portion 125, and a notch 127 communicating with the through hole 126 from an edge of the fixing portion 125 away from the main body 12.

Each screw 20 includes a non-threaded portion 21, and a threaded post 23 extending from an end of the non-threaded portion 21. A diameter of each non-threaded portion 21 is larger than a diameter of the through hole 126 of the corresponding fixing portion 125.

Figure 2:
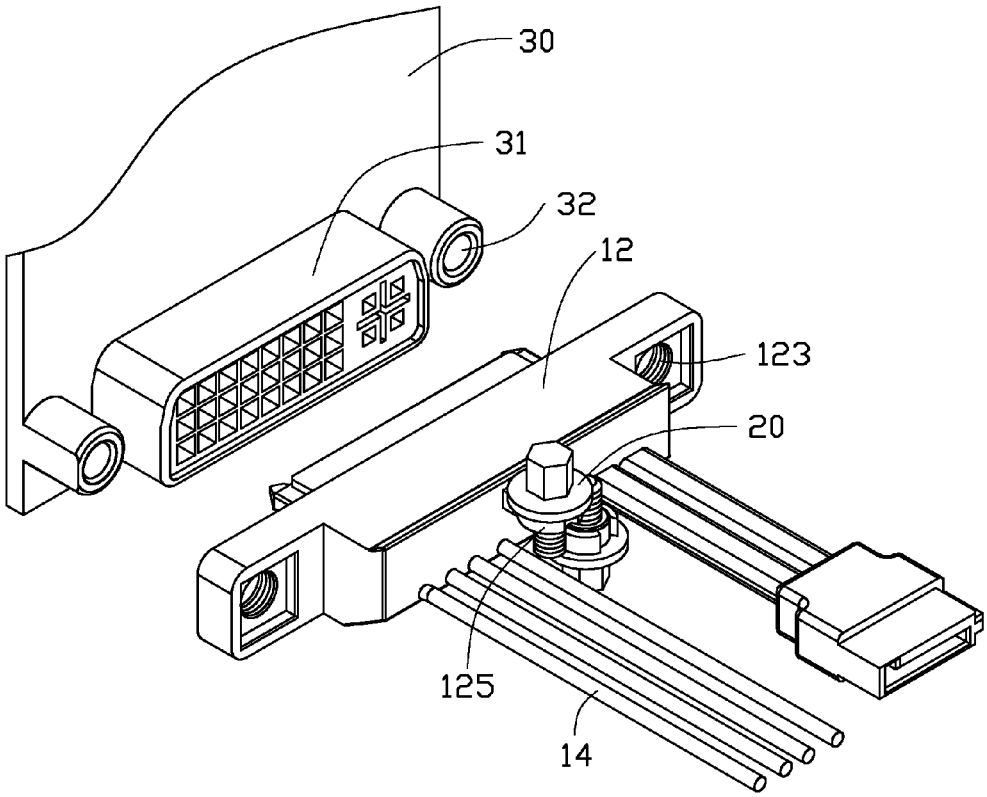
FIG. 2 is an assembled, isometric view of FIG. 1.

Referring to FIG. 2, in assembly, the posts 23 of the screws 20 are extended through the through holes 126 of the fixing portions 125, to allow the non-threaded portions 21 to be inserted into the through holes 126. The notches 127 are expanded, and the fixing portions 125 are deformed to tightly hold the non-threaded portions 21 of the corresponding screws 20.

To assemble the connector assembly to the connector interface 31 of the electronic device 30, the screws 20 are pulled out of the fixing portions 125. The connection portion 121 of the connector 10 is inserted into the corresponding connector interface 31. Then, the posts 23 of the screws 20 are extended through the threaded holes 123 of the connector 10 and engage in two corresponding threaded holes 32 of the electronic device 30. Thereby, the connector 10 is connected to the electronic device 30.

In this embodiment, the fixing portions 125 are separated from each other. In other embodiments, to save money on materials, the fixing portions 125 are integrally formed.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A connector assembly, comprising:

a connector comprising a main body, a cable connected to a rear side of the main body, and a connection portion protruding from a front side of the main body for connecting to an object, two threaded holes defined in opposite ends of the main body, respectively, two resilient fixing portions protruding from the rear side of the main body, a through hole defined in each of the fixing portions; and two screws detachably received into the corresponding through holes of the fixing portions when the connector is not connected to the object, wherein the fixing portions are deformed and tightly hold the corresponding screws, and after the screws are pulled to be detached from the fixing portions, the fixing portions are restored, and the screw are operable to mount the connector to the object by extending through the threaded holes of the connector and engaging in the object;

wherein the fixing portions are separated from each other, each of the fixing portions is substantially C-shaped, a notch is defined in an edge of each of the fixing portions communicating with a rear end of the corresponding through hole away from the main body, when the screws are received into the corresponding through holes of the fixing portions, the notches are expanded to allow the fixing portions to deform and tightly hold the corresponding screws.

2. The connector assembly of claim 1, wherein the fixing portions are integrally formed, two notches are defined in edges of the fixing portions communicating with rear ends of the corresponding through holes away from the main body, respectively, when the screws are received into the corresponding through holes of the fixing portions, the notches are expanded to allow the fixing portions to deform and tightly hold the corresponding screws.

3. The connector assembly of claim 1, wherein each of the screws comprises a non-threaded portion to engage in the corresponding through hole, and a threaded post extending from an end of the non-threaded portion to engage with the object, a diameter of each non-threaded portion is larger than a diameter of the corresponding through hole.

* * * * *